US008612214B2

(12) United States Patent
Neuendorf et al.

(10) Patent No.: US 8,612,214 B2
(45) Date of Patent: Dec. 17, 2013

(54) APPARATUS AND A METHOD FOR GENERATING BANDWIDTH EXTENSION OUTPUT DATA

(75) Inventors: Max Neuendorf, Nuremberg (DE); Bernhard Grill, Lauf (DE); Ulrich Kraemer, Stuttgart (DE); Markus Multrus, Nuremberg (DE); Harald Popp, Tuchenbach (DE); Nikolaus Rettelbach, Nuremberg (DE); Frederik Nagel, Nuremberg (DE); Markus Lohwasser, Hersbruck (DE); Marc Gayer, Erlangen (DE); Manuel Jander, Erlangen (DE); Virgilio Bacigalupo, Nuremberg (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 233 days.

(21) Appl. No.: 13/004,264

(22) Filed: Jan. 11, 2011

(65) Prior Publication Data

US 2011/0202352 A1 Aug. 18, 2011

Related U.S. Application Data

(63) Continuation of application No. PCT/EP2009/004521, filed on Jun. 23, 2009.

(60) Provisional application No. 61/079,841, filed on Jul. 11, 2009.

(51) Int. Cl.
*G10L 19/00* (2013.01)

(52) U.S. Cl.
USPC ..... 704/201; 704/200; 704/500; 704/501

(58) Field of Classification Search
USPC ..... 704/200–201, 500–502
See application file for complete search history.

(56) References Cited

U.S. PATENT DOCUMENTS 6,134,518 A 10/2000 Cohen et al.
7,050,972 B2 5/2006 Henn et al.

(Continued)

FOREIGN PATENT DOCUMENTS

EP 1216474 7/2004
EP 1672618 A1 6/2006

(Continued)

OTHER PUBLICATIONS

International Search Report, mailed Jan. 11, 2010, in related PCT application PCT/EP2009/004523, 7 pages.

(Continued)

*Primary Examiner* — Douglas Godbold
(74) *Attorney, Agent, or Firm* — Michael A. Glenn; Perkins Coie LLP

(57) ABSTRACT

An apparatus for generating bandwidth extension output data for an audio signal has a noise floor measurer, a signal energy characterizer and a processor. The audio signal has components in a first frequency band and components in a second frequency band, the bandwidth extension output data are adapted to control a synthesis of the components in the second frequency band. The noise floor measurer measures noise floor data of the second frequency band for a time portion of the audio signal. The signal energy characterizer derives energy distribution data, the energy distribution data characterizing an energy distribution in a spectrum of the time portion of the audio signal. The processor combines the noise floor data and the energy distribution data to obtain the bandwidth extension output data.

21 Claims, 7 Drawing Sheets

(56) References Cited

U.S. PATENT DOCUMENTS

| | | | | |
|---|---|---|---|---|
| 7,991,621 | B2 | 8/2011 | Oh et al. | |
| 8,036,394 | B1 * | 10/2011 | Yonemoto et al. | 381/61 |
| 2003/0004711 | A1 | 1/2003 | Koishida et al. | |
| 2004/0125878 | A1 | 7/2004 | Lijeryd et al. | |
| 2005/0096917 | A1 * | 5/2005 | Kjorling et al. | 704/500 |
| 2005/0177363 | A1 | 8/2005 | Oh | |
| 2005/0267746 | A1 | 12/2005 | Jelinek et al. | |
| 2006/0106619 | A1 | 5/2006 | Iser et al. | |
| 2006/0136211 | A1 | 6/2006 | Jiang et al. | |
| 2006/0256971 | A1 | 11/2006 | Chong et al. | |
| 2007/0016411 | A1 * | 1/2007 | Kim et al. | 704/226 |
| 2007/0106502 | A1 | 5/2007 | Kim et al. | |
| 2007/0150269 | A1 * | 6/2007 | Nongpiur et al. | 704/226 |
| 2007/0225971 | A1 | 9/2007 | Bessette | |
| 2007/0282603 | A1 | 12/2007 | Bessette | |
| 2008/0027715 | A1 | 1/2008 | Rajendran et al. | |
| 2008/0097751 | A1 | 4/2008 | Tsuchinaga et al. | |
| 2008/0120116 | A1 * | 5/2008 | Schnell et al. | 704/500 |
| 2008/0260048 | A1 | 10/2008 | Oomen et al. | |
| 2009/0076829 | A1 | 3/2009 | Ragot et al. | |
| 2009/0110208 | A1 * | 4/2009 | Choo et al. | 381/71.1 |
| 2009/0132261 | A1 * | 5/2009 | Kjorling et al. | 704/500 |
| 2009/0157413 | A1 | 6/2009 | Oshikiri | |
| 2009/0319259 | A1 * | 12/2009 | Liljeryd et al. | 704/200.1 |
| 2010/0121646 | A1 | 5/2010 | Ragot et al. | |
| 2010/0211399 | A1 * | 8/2010 | Liljeryd et al. | 704/500 |
| 2010/0286990 | A1 | 11/2010 | Biswas et al. | |
| 2010/0286991 | A1 | 11/2010 | Hedelin et al. | |
| 2011/0173004 | A1 * | 7/2011 | Bessette et al. | 704/500 |
| 2011/0200198 | A1 | 8/2011 | Grill et al. | |

FOREIGN PATENT DOCUMENTS

| | | | |
|---|---|---|---|
| EP | 2056294 | | 5/2009 |
| EP | 2077551 | A | 3/2011 |
| JP | 2004350077 | | 12/2004 |
| JP | 2007171954 | | 5/2007 |
| JP | 2007524124 | | 8/2007 |
| JP | 2008107415 | | 8/2008 |
| RU | 2256293 | | 7/2005 |
| RU | 2005113877 | | 10/2005 |
| WO | 0045379 | | 8/2000 |
| WO | WO00/45379 | | 8/2000 |
| WO | WO00/63887 | A1 | 10/2000 |
| WO | WO01/26095 | A1 | 4/2001 |
| WO | WO02/41302 | | 5/2002 |
| WO | WO03/046891 | | 6/2003 |
| WO | WO2004/114133 | | 12/2004 |
| WO | WO2006/000110 | | 1/2006 |
| WO | WO-2007128662 | | 11/2007 |
| WO | WO2008/031458 | | 3/2008 |
| WO | 2008060068 | | 5/2008 |
| WO | WO2009/081315 | | 7/2009 |

OTHER PUBLICATIONS

Int'l Preliminary Report on Patentability, mailed Jan. 11, 2011, in related PCT application PCT/EP2009/004523, 9 pages.

* cited by examiner $$c_k = \frac{1}{k} \sum_{n=1}^{N} (p_n)^k$$

cepstral coefficients corresponding to $N^{th}$ order all-pole log power spectrum $$m = \frac{-48}{\pi^3} \sum_{k=1,3,5,\ldots}^{\infty} \left\{ \frac{1}{k^3} \sum_{n=1}^{N} (p_n)^k \right\}$$

spectral tilt in terms of cepstral coefficients $$S(\omega) = \ln |H(e^{j\omega})|^2 = \ln G^2 - \ln \left| 1 - \sum_{k-1}^{N} a_k e^{-j\omega k} \right|^2$$

log power spectrum of $N^{th}$ order LPC filter $$c_k = \begin{cases} \alpha_k + \frac{1}{k} \sum_{n=1}^{k-1} n c_n \alpha_{k-n}, & 1 \le k \le N; \\ \frac{1}{k} \sum_{n=k=N}^{k-1} n c_n \alpha_{k-n}, & k > N. \end{cases}$$

cepstral coefficients $c_k$ in dependence on LPC coefficients $\alpha_k$ $\alpha_1$: first LPC coefficient - has positive or negative sign

FIG 2C

APPARATUS AND A METHOD FOR GENERATING BANDWIDTH EXTENSION OUTPUT DATA

CROSS-REFERENCE TO RELATED APPLICATIONS

This application is a continuation of copending International Application No. PCT/EP2009/004521, filed Jun. 23, 2009, which is incorporated herein by reference in its entirety, and additionally claims priority from U.S. Provisional Application No. U.S. 61/079,841, filed Jul. 11, 2008, which is also incorporated herein by reference in its entirety.

BACKGROUND OF THE INVENTION

The present invention relates to an apparatus and a method for generating bandwidth extension (BWE) output data, an audio encoder and an audio decoder.

Natural audio coding and speech coding are two major classes of codecs for audio signals. Natural audio coding is commonly used for music or arbitrary signals at medium bit rates and generally offers wide audio bandwidths. Speech coders are basically limited to speech reproduction and may be used at very low bit rate. Wide band speech offers a major subjective quality improvement over narrow band speech. Further, due to the tremendous growth of the multimedia field, transmission of music and other non-speech signals as well as storage and, for example, transmission for radio/TV at high quality over telephone systems is a desirable feature.

To drastically reduce the bit rate, source coding can be performed using split-band perceptual audio codecs. These natural audio codecs exploit perceptual irrelevance and statistical redundancy in the signal. In case exploitation of the above alone is not sufficient with respect to the given bit rate constraints the sample rate is reduced. It is also common to decrease the number of composition levels, allowing occasional audible quantization distortion, and to employ degradation of the stereo field through joint stereo coding or parametric coding of two or more channels. Excessive use of such methods results in annoying perceptual degradation. In order to improve the coding performance, bandwidth extension methods such as spectral band replication (SBR) is used as an efficient method to generate high frequency signals in an HFR (high frequency reconstruction) based codec.

In recording and transmitting acoustic signals a noise floor such as background noise is always present. In order to generate an authentic acoustic signal on the decoder side, the noise floor should either be transmitted or be generated. In the latter case, the noise floor in the original audio signal should be determined. In spectral band replication, this is performed by SBR tools or SBR related modules, which generate parameters that characterize (besides other things) the noise floor and that are transmitted to the decoder to reconstruct the noise floor.

In WO 00/45379, an adaptive noise floor tool is described, which provides sufficient noise contents in the synthesized high band frequency components. However, disturbing artifacts in the high band frequency components are generated if, in the base band, short-time energy fluctuations or so-called transients occur. These artifacts are perceptually not acceptable and known technology does not provide an acceptable solution (especially if the bandwidth is limited).

SUMMARY

According to an embodiment, an encoder for encoding an audio signal, the audio signal comprising components in a first frequency band and components in a second frequency band, may have: a core coder for encoding the components in the first frequency band to obtain an encoded audio signal; an envelope data calculator for calculating bandwidth extension (BWE) data based on the components in the second frequency band, the envelope data calculator comprising an apparatus for generating bandwidth extension output data for the audio signal, the bandwidth extension output data being adapted to control a synthesis of the components in the second frequency band, the apparatus comprising: a noise floor measurer for measuring noise floor data of the second frequency band for a time portion of the audio signal; a signal energy characterizer for deriving energy distribution data, the energy distribution data characterizing an energy distribution in a spectrum of the time portion of the audio signal; and a processor for combining the noise floor data and the energy distribution data to obtain the bandwidth extension output data, wherein the bandwidth extension data comprise the bandwidth extension data and envelope data; and a bitstream payload formatter adapted for outputting a coded audio stream by combining the bandwidth extension data with the encoded audio signal, wherein the processor is part of the bitstream payload formatter.

According to another embodiment, a method of encoding an audio signal, the audio signal comprising components in a first frequency band and components in a second frequency band, may have the steps of: encoding the components in the first frequency band to obtain an encoded audio signal; calculating bandwidth extension data by an envelope data calculator based on the components in the second frequency band, the step of calculating comprising a step of generating bandwidth extension output data for the audio signal, the bandwidth extension output data being adapted to control a synthesis of the components in the second frequency band, the step of generating bandwidth extension output data comprising: measuring noise floor data of the second frequency band for a time portion of the audio signal; deriving energy distribution data, the energy distribution data characterizing an energy distribution in a spectrum of the time portion of the audio signal; and combining the noise floor data and the energy distribution data to obtain the bandwidth extension output data; and wherein the bandwidth extension data comprise the bandwidth extension output data and envelope data, and bitstream payload formatting and outputting a coded audio stream by combining the bandwidth extension data with the encoded audio signal, wherein the step of combining is part of the step of bitstream payload formatting.

According to another embodiment, a bandwidth extension tool for generating components in a second frequency band of an audio signal based on bandwidth extension output data and based on a raw signal spectral representation for the components in the second frequency band, wherein the bandwidth extension output data comprise energy distribution data, the energy distribution data characterizing an energy distribution in a spectrum of a time portion of the audio signal, may have: a noise floor modifier tool, which is configured to modify a transmitted noise floor in accordance to the energy distribution data; and a combiner for combining the raw signal spectral representation with the modified noise floor to generate the components in the second frequency band with the modified noise floor.

According to another embodiment, a decoder for decoding a coded audio stream to obtain an audio signal may have: a bitstream deformatter separating an encoded signal and the BWE output data; a bandwidth extension tool as mentioned above; a core decoder for decoding components in a first frequency band from the encoded audio signal; and a synthesis unit for synthesizing the audio signal by combining the components of the first and second frequency band.

According to still another embodiment, a method for decoding a coded audio stream to obtain an audio signal, the audio signal comprising components in a first frequency band and bandwidth extension output data, wherein the bandwidth extension output data comprise energy distribution data and noise floor data, the energy distribution data characterizing an energy distribution in a spectrum of a time portion of the audio signal, may have the steps of: separating from the coded audio stream an encoded audio signal and the BWE output data; decoding components in a first frequency band from the encoded audio signal; generating a raw signal spectral representation for components in a second frequency band from the components in the first frequency band; modifying a noise floor in accordance to the energy distribution data and in accordance to the transmitted noise floor data; combining the raw signal spectral representation with the modified noise floor to generate the components in the second frequency band with the calculated noise floor; and synthesizing the audio signal by combining the components of the first and second frequency band.

Another embodiment may have a computer program for performing, when running on a computer, the method of encoding an audio signal mentioned above or the method of decoding a coded audio stream as mentioned above.

According to another embodiment, an encoded audio stream may have: an encoded audio signal for components in a first frequency band of an audio signal; noise floor data adapted to control a synthesis of a noise floor for components in a second frequency band of the audio signal; energy distribution data adapted to control a modification of the noise floor; and envelope data for the components in the second frequency band.

The present invention is based on the finding that an adaptation of a measured noise floor depending on energy distribution of the audio signal within a time portion can improve the perceptual quality of a synthesized audio signal on the decoder side. Although from the theoretical standpoint an adaptation or manipulation of the measured noise floor is not needed, the conventional techniques to generate the noise floor show a number of drawbacks. On the one hand, the estimation of the noise floor based on a tonality measure, as it is performed by conventional methods, is difficult and not always accurate. On the other hand, the aim of the noise floor is to reproduce the correct tonality impression on the decoder side. Even if the subjective tonality impression for the original audio signal and the decoded signal is the same, there is still the possibility of generated artifacts; e.g. for speech signals.

Subjective tests show that different types of speech signals should be treated differently. In voiced speech signals a lowering of the calculated noise floor yields a perceptually higher quality when compared to the original calculated noise floor. As result speech sounds less reverberant in this case. In case the audio signal comprise sibilants an artificial increase of the noise floor may cover up drawbacks in the patching method related to sibilants. For example, short-time energy fluctuations (transients) produce disturbing artifacts when shifted or transformed into the higher frequency band and an increase in the noise floor may also cover these energy fluctuations up.

Said transients may be defined as portions within conventional signals, wherein a strong increase in energy appears within a short period of time, which may or may not be constrained on a specific frequency region. Examples for transients are hits of castanets and of percussion instruments, but also certain sounds of the human voice as, for example, the letters: P, T, K, . . . . The detection of this kind of transient is implemented so far always in the same way or by the same algorithm (using a transient threshold), which is independent of the signal, whether it is classified as speech or classified as music. In addition, a possible distinction between voiced and unvoiced speech does not influence the conventional or classical transient detection mechanism.

Hence, embodiments provide a decrease of the noise floor for signals such as voiced speech and an increase of the noise floor for signals comprising, e.g., sibilants.

To distinguish the different signals, embodiments use energy distribution data (e.g. a sibilance parameter) that measure whether the energy is mostly located at higher frequencies or at lower frequencies, or in other words, whether the spectral representation of the audio signal shows an increasing or decreasing tilt towards higher frequencies. Further embodiments also use the first LPC coefficient (LPC=linear predictive coding) to generate the sibilance parameter.

There are two possibilities for changing the noise floor. The first possibility is to transmit said sibilance parameter so that the decoder can use the sibilance parameter in order to adjust the noise floor (e.g. either to increase or decrease the noise floor in addition to the calculated noise floor). This sibilance parameter may be transmitted in addition to the calculated noise floor parameter by conventional methods or calculated on decoder side. A second possibility is to change the transmitted noise floor by using the sibilance parameter (or the energy distribution data) so that the encoder transmits modified noise floor data to the decoder and no modifications are needed on the decoder side—the same decoder may be used. Therefore, the manipulation of the noise floor can in principle be done on the encoder side as well as on the decoder side.

The spectral band replication as an example for the bandwidth extension relies on SBR frames defining a time portion in which the audio signal is separated into components in the first frequency band and the second frequency band. The noise floor can be measured and/or changed for the whole SBR frame. Alternatively, it is also possible that the SBR frame is divided into noise envelopes, so that for each of the noise envelopes, an adjustment for the noise floor can be performed. In other words, the temporal resolution of the noise floor tools is determined by the so-called noise-envelopes within the SBR frames. According to the Standard (ISO/IEC 14496-3), each SBR frame comprises a maximum of two noise-envelopes, so that an adjustment of the noise floor can be made on the basis partial SBR frames. For some applications, this might be sufficient. It is, however, also possible to increase the number of noise-envelopes in order to improve the model for temporal varying tonality.

Hence, embodiments comprise an apparatus for generating BWE output data for an audio signal, wherein the audio signal comprises components in a first frequency band and a second frequency band and the BWE output data is adapted to control a synthesis of the components in the second frequency band. The apparatus comprises a noise floor measurer for measuring noise floor data of the second frequency band for a time portion of the audio signal. Since the measured noise floor influences the tonality of the audio signal, the noise floor measurer may comprise a tonality measurer. Alternatively, the noise floor measurer can be implemented to measure the noisiness of a signal in order to obtain the noise floor. The apparatus further comprises a signal-energy characterizer for deriving energy distribution data, wherein the energy distribution data characterize an energy distribution in a spectrum of the time portion of the audio signal and, finally, the apparatus comprises a processor for combining the noise floor data and the energy distribution data to obtain the BWE output data.

In further embodiments, the signal energy characterizer is adapted to use the sibilance parameter as the energy distribution data and the sibilance parameter can, for example, be the first LPC coefficient. In further embodiments, the processor is adapted to add the energy distribution data to the bitstream of encoded audio data or, alternatively, the processor is adapted to adjust the noise floor parameter such that the noise floor is either increased or decreased depending on the energy distribution data (signal dependent). In this embodiment, the noise floor measurer will first measure the noise floor to generate noise floor data, which will be adjusted or changed by the processor later on.

In further embodiments, the time portion is an SBR frame and the signal energy characterizer is adapted to generate a number of noise floor envelopes per SBR frame. As a consequence, the noise floor measurer as well as the signal energy characterizer may be adapted to measure the noise floor data as well as the derived energy distribution data for each noise floor envelope. The number of noise floor envelopes can, for example, be 1, 2, 4, . . . per SBR frame.

Further embodiments comprise also a spectral band replication tool used in a decoder to generate components in a second frequency band of the audio signal. In this generation spectral band replication output data and raw signal spectral representation for the components in the second frequency band are used. The spectral band replication tool comprises a noise floor calculation unit, which is configured to calculate a noise floor in accordance to the energy distribution data, and a combiner for combining the raw signal spectral representation with the calculated noise floor to generate the components in the second frequency band with the calculated noise floor.

An advantage of embodiments is the combination of an external decision (speech/audio) with an internal voiced speech detector or an internal sibilant detector (a signal energy characterizer) controlling the event of additional noise being signaled to the decoder or adjusting the calculated noise floor. For non-speech signals, the usual noise floor calculation is executed. For speech signals (derived from the external switching decision) an additional speech analysis is performed to determine the actual signal's voicing. The amount of noise to be added in the decoder or encoder is scaled depending on the degree of sibilance (to be contrary to voicing) of the signal. The degree of sibilance can be determined, for example, by measuring the spectral tilt of short-signal parts.

BRIEF DESCRIPTION OF THE DRAWINGS

The present invention will now be described by way of illustrated examples. Features of the invention will be more readily appreciated and better understood by reference to the following detailed description, which should be considered with reference to the accompanying drawings, in which:

FIG. 2*c* explains the calculation of the spectral tilt m based on low-order LPC parameters;

DETAILED DESCRIPTION OF THE INVENTION

Figure 1:
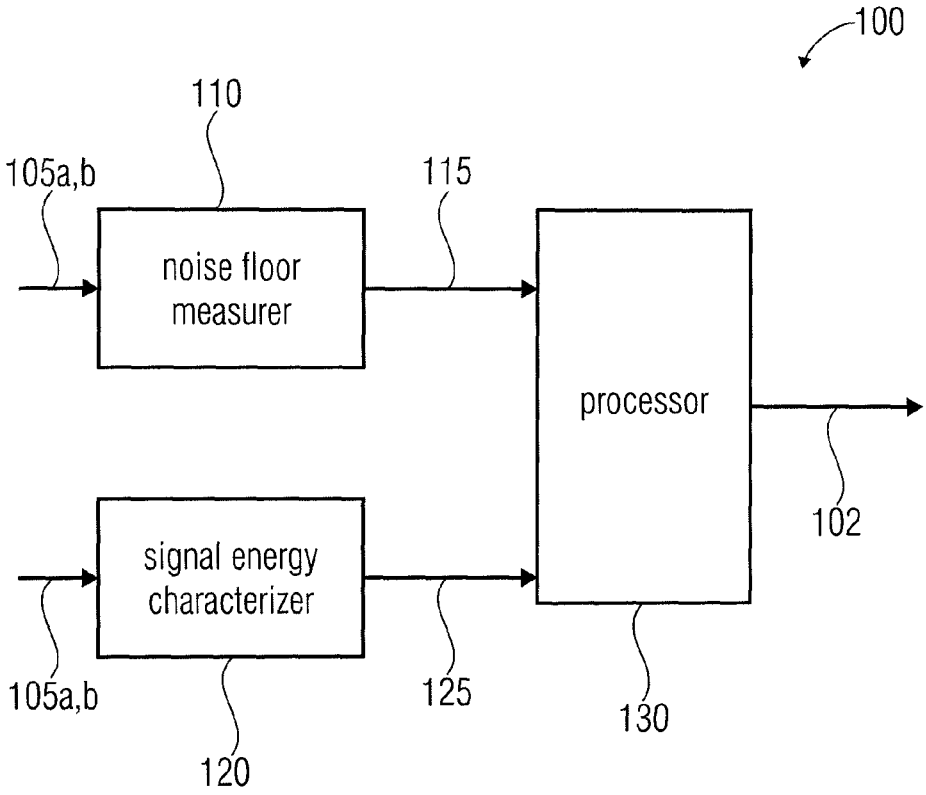
FIG. 1 shows a block diagram of an apparatus for generating BWE output data according to embodiments of the present invention.

FIG. 1 shows an apparatus 100 for generating bandwidth extension (BWE) output data 102 for an audio signal 105. The audio signal 105 comprises components in a first frequency band 105*a* and components of a second frequency band 105*b*. The BWE output data 102 are adapted to control a synthesis of the components in the second frequency band 105*b*. The apparatus 100 comprises a noise floor measurer 110, a signal energy characterizer 120 and a processor 130. The noise floor measurer 110 is adapted to measure or determine noise floor data 115 of the second frequency band 105*b* for a time portion of the audio signal 105. In detail, the noise floor may be determined by comparing the measured noise of the base band with the measured noise of the upper band, so that the amount of noise needed after patching to reproduce a natural tonality impression may be determined. The signal energy characterizer 120 derives energy distribution data 125 characterizing an energy distribution in a spectrum of the time portion of the audio signal 105. Therefore, the noise floor measurer 110 receives, for example, the first and/or second frequency band 105*a,b* and the signal energy characterizer 120 receives, for example, the first and/or the second frequency band 105*a, b*. The processor 130 receives the noise floor data 115 and the energy distribution data 125 and combines them to obtain the BWE output data 102. Spectral band replication comprises one example for the bandwidth extension, wherein the BWE output data 102 become SBR output data. The following embodiments will mainly describe the example of SBR, but the inventive apparatus/method is not restricted to this example.

The energy distribution data 125 indicates a relation between the energy contained within the second frequency band compared to the energy contained in the first frequency band. In the simplest case the energy distribution data is given by a bit indicating whether more energy is stored within the base band compared to the SBR band (upper band) or vice versa. The SBR band (upper band) may, for example, be defined as frequency components above a threshold, which may be given, for example, by 4 kHz and the base band (lower band) may be the components of the signal, which are below this threshold frequency (for example, below 4 kHz or another frequency). Examples for these threshold frequencies would be 5 kHz or 6 kHz.

Figure 2A:
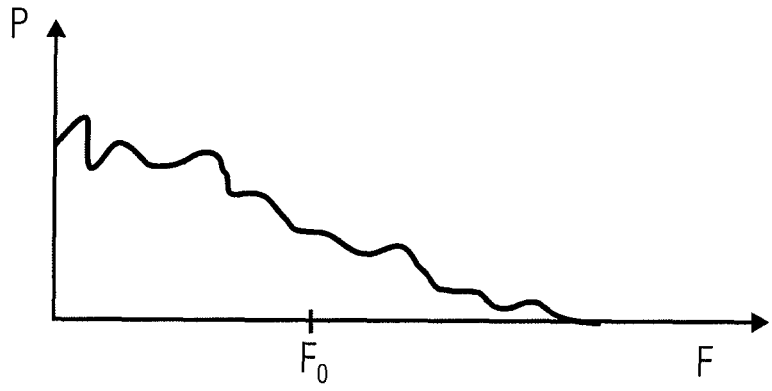
FIG. 2*a* illustrates a negative spectral tilt of a non-sibilant signal.
Figure 2B:
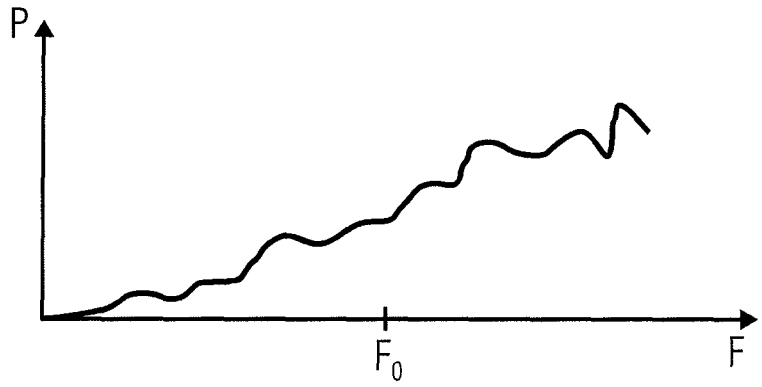
FIG. 2*b* illustrates a positive spectral tilt for a sibilant-like signal.

FIGS. 2*a* and 2*b* show two energy distributions in the spectrum within a time portion of the audio signal 105. The energy distributions displayed by a level P as a function of the frequency F as analog signal, which may also be an envelope of a signal given by a plurality of samples or lines (transformed into the frequency domain). The shown graphs are also much simplified to visualize the spectral tilt concept. The lower and upper frequency band may be defined as frequencies below or above a threshold frequency $F_0$ (cross over frequency, e.g. 500 Hz, 1 kHz or 2 kHz).

FIG. 2*a* shows an energy distribution exhibiting a falling spectral tilt (decreasing with higher frequencies). In other words, in this case, there is more energy stored in the low frequency components than in the high frequency components. Hence, the level P decreases for higher frequencies implying a negative spectral tilt (decreasing function). Hence, a level P comprises a negative spectral tilt if the signal level P indicates that there is less energy in the upper band ($F>F_0$) than in the lower band ($F<F_0$). This type of signal occurs, for example, for an audio signal comprising a low or no amount of sibilance.

FIG. 2*b* shows the case, wherein the level P increases with the frequencies F implying a positive spectral tilt (an increasing function of the level P depending on the frequencies). Hence, the level P comprises a positive spectral tilt if the signal level P indicates that there is more energy in the upper band ($F>F_0$) compared to the lower band ($F<F_0$). Such an energy distribution is generated if the audio signal 105 comprises, for example, said sibilants.

FIG. 2*a* illustrates a power spectrum of a signal having a negative spectral tilt. A negative spectral tilt means a falling slope of the spectrum. Contrary thereto, FIG. 2*b* illustrates a power spectrum of a signal having a positive spectral tilt. Said in other words, this spectral tilt has a rising slope. Naturally, each spectrum such as the spectrum illustrated in FIG. 2*a* or the spectrum illustrated in FIG. 2*b* will have variations in a local scale which have slopes different from the spectral tilt.

The spectral tilt may be obtained, when, for example, a straight line is fitted to the power spectrum such as by minimizing the squared differences between this straight line and the actual spectrum. Fitting a straight line to the spectrum can be one of the ways for calculating the spectral tilt of a short-time spectrum. However, it is of advantage to calculate the spectral tilt using LPC coefficients.

The publication "Efficient calculation of spectral tilt from various LPC parameters" by V. Goncharoff, E. Von Colln and R. Morris, Naval Command, Control and Ocean Surveillance Center (NCCOSC), RDT and E Division, San Diego, Calif. 92152-52001, May 23, 1996 discloses several ways to calculate the spectral tilt.

In one implementation, the spectral tilt is defined as the slope of a least-squares linear fit to the log power spectrum. However, linear fits to the non-log power spectrum or to the amplitude spectrum or any other kind of spectrum can also be applied. This is specifically true in the context of the present invention, where, in an embodiment, one is mainly interested in the sign of the spectral tilt, i.e., whether the slope of the linear fit result is positive or negative. The actual value of the spectral tilt, however, is of no big importance in a high efficiency embodiment of the present invention, but the actual value can be important in more elaborate embodiments.

When linear predictive coding (LPC) of speech is used to model its short-time spectrum, it is computationally more efficient to calculate spectral tilt directly from the LPC model parameters instead of from the log power spectrum. FIG. 2*c* illustrates an equation for the cepstral coefficients $c_k$ corresponding to the $n^{th}$ order all-pole log power spectrum. In this equation, k is an integer index, $p_n$ is the $n^{th}$ pole in the all-pole representation of the z-domain transfer function H(z) of the LPC filter. The next equation in FIG. 2*c* is the spectral tilt in terms of the cepstral coefficients. Specifically, m is the spectral tilt, k and n are integers and N is the highest order pole of the all-pole model for H(z). The next equation in FIG. 2*c* defines the log power spectrum $S(\omega)$ of the $N^{th}$ order LPC filter. G is the gain constant and $a_k$ are the linear predictor coefficients, and $\omega$ is equal to 2×□×f, where f is the frequency. The lowest equation in FIG. 2*c* directly results in the cepstral coefficients as a function of the LPC coefficients $\alpha_k$. The cepstral coefficients $c_k$ are then used to calculate the spectral tilt. Generally, this method will be more computationally efficient than factoring the LPC polynomial to obtain the pole values, and solving for spectral tilt using the pole equations. Thus, after having calculated the LPC coefficients $\alpha_k$, one can calculate the cepstral coefficients $c_k$ using the equation at the bottom of FIG. 2*c* and, then, one can calculate the poles $p_n$ from the cepstral coefficients using the first equation in FIG. 2*c*. Then, based on the poles, one can calculate the spectral tilt m as defined in the second equation of FIG. 2*c*.

It has been found that the first order LPC coefficient $\alpha_1$ is sufficient for having a good estimate for the sign of the spectral tilt. $\alpha_1$ is, therefore, a good estimate for $c_1$ . Thus, $c_1$ is a good estimate for $p_1$. When $p_1$ is inserted into the equation for the spectral tilt m, it becomes clear that, due to the minus sign in the second equation in FIG. 2*c*, the sign of the spectral tilt m is inverse to the sign of the first LPC coefficient $\alpha_1$ in the LPC coefficient definition in FIG. 2*c*.

The signal energy characterizer 120 may be configured to generate, as the energy distribution data, an indication on a sign of the spectral tilt of the audio signal in a current time portion of the audio signal.

The signal energy characterizer 120 may be configured to generate, as the energy distribution data, data derived from an LPC analysis of a time portion of the audio signal for estimating one or more low order LPC coefficients and derive the energy distribution data from the one or more low order LPC coefficients.

The signal energy characterizer 120 may be configured only calculate the first LPC coefficient and to not calculate additional LPC coefficients and to derive the energy distribution data from a sign of the first LPC coefficient.

The signal energy characterizer 120 may be configured for determining the spectral tilt as a negative spectral tilt, in which a spectral energy decreases from lower frequencies to higher frequencies, when the first LPC coefficient has a positive sign, and to detect the spectral tilt as a positive spectral tilt, in which the spectral energy increases from lower frequencies to higher frequencies, when the first LPC coefficient has a negative sign.

In other embodiments, the spectral tilt detector or signal energy characterizer 120 is configured to not only calculate the first order LPC coefficients but to calculate several low order LPC coefficients such as LPC coefficients until the order of 3 or 4 or even higher. In such an embodiment, the spectral tilt is calculated to such an high accuracy that one can not only indicate the sign as a sibilance parameter, but also a value depending on the tilt, which has more than two values as in the sign embodiment.

As said above sibilance comprises a large amount of energy in the upper frequency region, whereas for parts with no or only little sibilance (for example, vowels) the energy is mostly distributed within the base band (the low frequency band). This observation can be used in order to determine whether or to which extend a speech signal part comprise a sibilant or not.

Hence, the noise floor measurer 110 (detector) can use the spectral tilt for the decision about the amount of sibilance or to give the degree of sibilance within a signal. The spectral tilt can basically be obtained from a simple LPC analysis of the energy distribution. It may, for example, be sufficient to calculate the first LPC coefficient in order to determine the spectral tilt parameter (sibilance parameter), because from the first LPC coefficient the behavior of the spectrum (whether an increasing or decreasing function) can be inferred. This analysis may be performed within the signal energy characterizer 120. In case the audio encoder uses LPC for decoding the audio signal, there may be no need to transmit the sibilance parameter, since the first LPC coefficient may be used as energy distribution data on the decoder side.

In embodiments the processor 130 may be configured to change the noise floor data 115 in accordance to the energy distribution data 125 (spectral tilt) to obtain modified noise floor data, and the processor 130 may be configured to add the modified noise floor data to a bitstream comprising the BWE output data 102. The change of the noise floor data 115 may be such that the modified noise floor is increased for an audio signal 105 comprising more sibilance (FIG. 2*b*) compared to an audio signal 105 comprising less sibilance (FIG. 2*a*).

Figure 3:
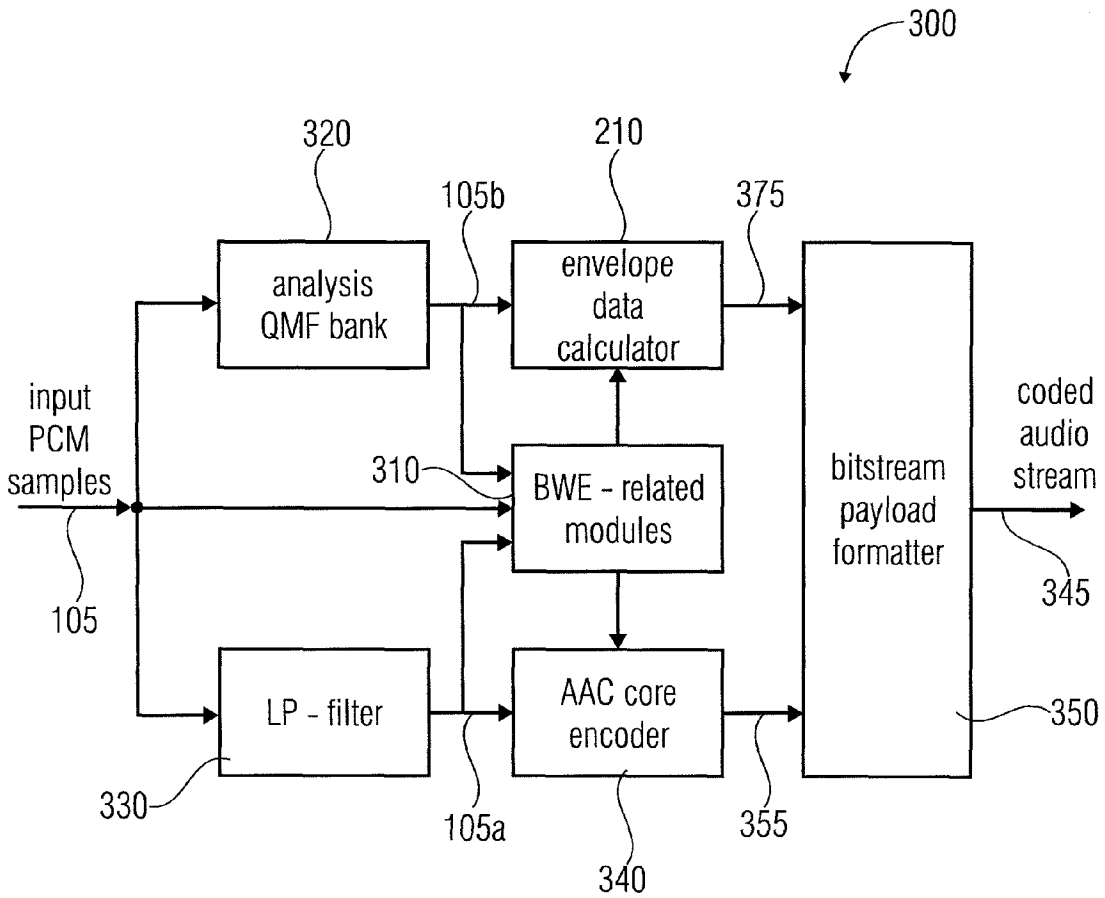
FIG. 3 shows a block diagram of an encoder.

The apparatus 100 for generating bandwidth extension (BWE) output data 102 can be part of an encoder 300. FIG. 3 shows an embodiment for the encoder 300, which comprises BWE related modules 310 (which may, e.g., comprise SBR related modules), an analysis QMF bank 320, a low pass filter (LP-filter) 330, an AAC core encoder 340 and a bit stream payload formatter 350. In addition, the encoder 300 comprises the envelope data calculator 210. The encoder 300 comprises an input for PCM samples (audio signal 105; PCM=pulse code modulation), which is connected to the analysis QMF bank 320, and to the BWE-related modules 310 and to the LP-filter 330. The analysis QMF bank 320 may comprise a high pass filter to separate the second frequency band 105*b* and is connected to the envelope data calculator 210, which, in turn, is connected to the bit stream payload formatter 350. The LP-filter 330 may comprise a low pass filter to separate the first frequency band 105*a* and is connected to the AAC core encoder 340, which, in turn, is connected to the bit stream payload formatter 350. Finally, the BWE-related module 310 is connected to the envelope data calculator 210 and to the AAC core encoder 340.

Therefore, the encoder 300 down-samples the audio signal 105 to generate components in the core frequency band 105*a* (in the LP-filter 330), which are input into the AAC core encoder 340, which encodes the audio signal in the core frequency band and forwards the encoded signal 355 to the bit stream payload formatter 350 in which the encoded audio signal 355 of the core frequency band is added to the coded audio stream 345 (a bit stream). On the other hand, the audio signal 105 is analyzed by the analysis QMF bank 320 and the high pass filter of the analysis QMF bank extracts frequency components of the high frequency band 105*b* and inputs this signal into the envelope data calculator 210 to generate BWE data 375. For example, a 64 sub-band QMF BANK 320 performs the sub-band filtering of the input signal. The output from the filterbank (i.e. the sub-band samples) are complex-valued and, thus, over-sampled by a factor of two compared to a regular QMF bank.

The BWE-related module 310 may, for example, comprise the apparatus 100 for generating the BWE output data 102 and controls the envelope data calculator 210 by providing, e.g., the BWE output data 102 (sibilance parameter) to the envelope data calculator 210. Using the audio components 105*b* generated by the Analysis QMF bank 320, the envelope data calculator 210 calculates the BWE data 375 and forwards the BWE data 375 to the bit stream payload formatter 350, which combines the BWE data 375 with the components 355 encoded by the core encoder 340 in the coded audio stream 345. In addition, the envelope data calculator 210 may for example use the sibilance parameter 125 to adjust the noise floors within the noise envelopes.

Alternatively, the apparatus 100 for generating the BWE output data 102 may also be part of the envelope data calculator 210 and the processor may also be part of the Bitstream payload formatter 350. Therefore, the different components of the apparatus 100 may be part of different encoder components of FIG. 3.

Figure 4:
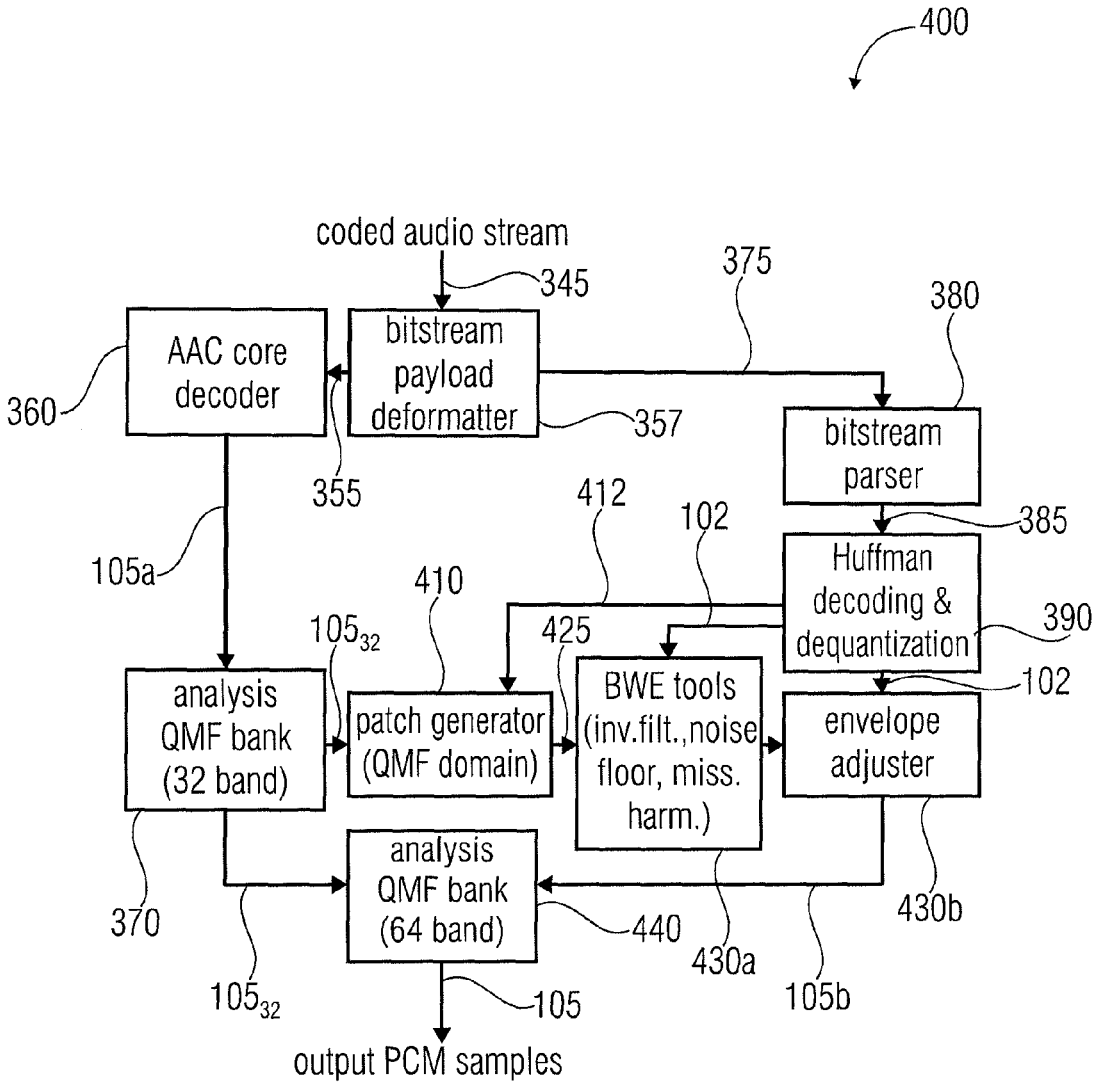
FIG. 4 shows block diagrams for processing the coded audio stream to output PCM samples on a decoder side.

FIG. 4 shows an embodiment for a decoder 400, wherein the coded audio stream 345 is input into a bit stream payload deformatter 357, which separates the coded audio signal 355 from the BWE data 375. The coded audio signal 355 is input into, for example, an AAC core decoder 360, which generates the decoded audio signal 105*a* in the first frequency band. The audio signal 105*a* (components in the first frequency band) is input into an analysis 32 band QMF-bank 370, generating, for example, 32 frequency subbands $\mathbf{105}_{32}$ from the audio signal 105*a* in the first frequency band. The frequency subband audio signal $\mathbf{105}_{32}$ is input into the patch generator 410 to generate a raw signal spectral representation 425 (patch), which is input into an BWE tool 430*a*. The BWE tool 430*a* may, for example, comprise a noise floor calculation unit to generate a noise floor. In addition, the BWE tool 430*a* may reconstruct missing harmonics or perform an inverse filtering step. The BWE tool 430*a* may implement known spectral band replication methods to be used on the QMF spectral data output of the patch generator 410. The patching algorithm used in the frequency domain could, for example, employ the simple mirroring or copying of the spectral data within the frequency domain.

On the other hand, the BWE data 375 (e.g. comprising the BWE output data 102) is input into a bit stream parser 380, which analyzes the BWE data 375 to obtain different sub-information 385 and input them into, for example, an Huffman decoding and dequantization unit 390 which, for example, extracts the control information 412 and the spectral band replication parameters 102. The control information 412 controls the patch generator 430 (e.g. to use a specific patching algorithm) and the BWE parameter 102 comprise, for example, also the energy distribution data 125 (e.g. the sibilance parameter). The control information 412 is input into the BWE tool 430*a* and the spectral band replication parameters 102 are input into the BWE tool 430*a* as well as into an envelope adjuster 430*b*. The envelope adjuster 430*b* is operative to adjust the envelope for the generated patch. As a result, the envelope adjuster 430*b* generates the adjusted raw signal 105*b* for the second frequency band and inputs it into a synthesis QMF-bank 440, which combines the components of the second frequency band 105*b* with the audio signal in the frequency domain $\mathbf{105}_{32}$. The synthesis QMF-bank 440 may, for example, comprise 64 frequency bands and generates by combining both signals (the components in the second frequency band 105*b* and the frequency domain audio signal $\mathbf{105}_{32}$) the synthesis audio signal 105 (for example, an output of PCM samples, PCM=pulse code modulation).

The synthesis QMF bank 440 may comprise a combiner, which combines the frequency domain signal $\mathbf{105}_{32}$ with the second frequency band 105*b* before it will be transformed into the time domain and before it will be output as the audio signal 105. Optionally, the combiner may output the audio signal 105 in the frequency domain.

The BWE tools 430*a* may comprise a conventional noise floor tool, which adds additional noise to the patched spectrum (the raw signal spectral representation 425), so that the spectral components 105*a* that have been transmitted by a core coder 340 and are used to synthesize the components of the second frequency band 105*b* exhibit the tonality of the second frequency band 105*b* of the original signal. Especially in voiced speech paths, however, the additional noise added by the conventional noise floor tool can harm the perceived quality of the reproduced signal.

According to embodiments the noise floor tool may be modified so that the noise floor tool takes into account the energy distribution data 125 (part of the BWE data 102) to change the noise floor in accordance to the detected degree of sibilance (see FIG. 2). Alternatively, as described above the decoder may not be modified and instead the encoder can change the noise floor data in accordance to the detected degree of sibilance.

FIG. 5 shows a comparison of a conventional noise floor calculation tool with a modified noise floor calculation tool according to embodiments of the present invention. This modified noise floor calculation tool may be part of the BWE tool 430.

Figure 5A:
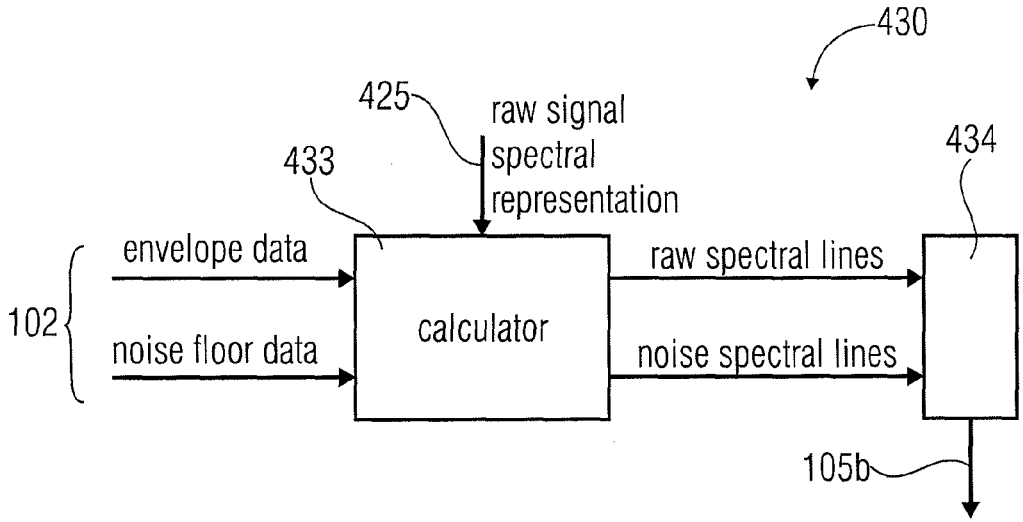
FIG. 5*a,b* show a comparison of a conventional noise floor calculation tool with a modified noise floor calculation tool according to embodiments.

FIG. 5*a* shows the conventional noise floor calculation tool comprising a calculator 433, which uses the spectral band replication parameters 102 and the raw signal spectral representation 425 in order to calculate raw spectral lines and noise spectral lines. The BWE data 102 may comprise envelope data and noise floor data, which are transmitted from the encoder as part of the coded audio stream 345. The raw signal spectral representation 425 is, for example, obtained from a patch generator, which generates components of the audio signal in the upper frequency band (synthesized components in the second frequency band 105*b*). The raw spectral lines and noise spectral lines will further be processed, which may involve an inverse filtering, envelope adjusting, adding missing harmonics and so on. Finally, a combiner 434 combines the raw spectral lines with the calculated noise spectral lines to the components in the second frequency band 105*b*.

Figure 5B:
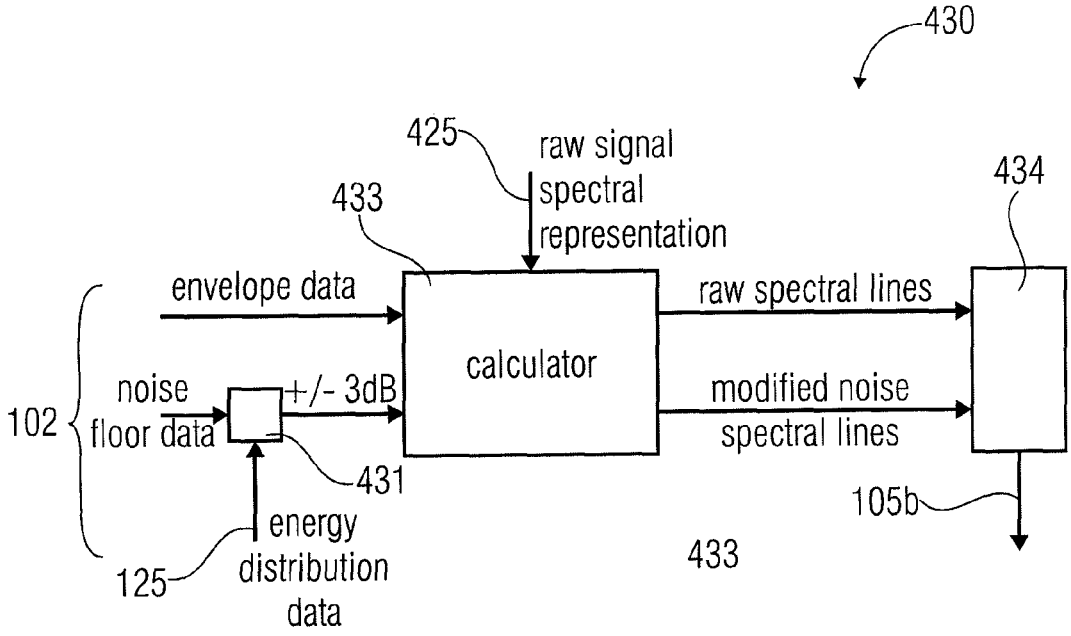

FIG. 5*b* shows a noise floor calculation tool according to embodiments of the present invention. In addition to the conventional noise floor calculation tool as shown in FIG. 5*a*, embodiments comprise a noise floor modifying unit 431 which is configured, for example, to modify the transmitted noise floor data based on the energy distribution data 125 before they are processed in the noise floor calculation tool 433. The energy distribution data 125 may also be transmitted from the encoder as part of or in addition to the BWE data 102. The modification of the transmitted noise floor data comprises, for example, an increase for a positive spectral tilt (see FIG. 2*a*) or decrease for a negative spectral tilt (see FIG. 2*b*) of the level of the noise floor, for example, an increase by 3 dB or a decrease by 3 dB or any other discrete value (e.g. +/−1 dB or +/−2 dB). The discrete value can be an integer dB value or a non-integer dB value. There may also be a functional dependence (e.g. a linear relation) between the decrease/increase and the spectral tilt.

Based on this modified noise floor data the noise floor calculation tool 433 calculates again raw spectral lines and modified noise spectral lines based on the raw signal spectral representation 425, which may again be obtained from a patch generator. The spectral band replication tool 430 of FIG. 5*b* comprise also a combiner 434 for combining the raw spectral lines with the calculated noise floor (with the modification from the modifying unit 431) to generate the components in the second frequency band 105*b*.

The energy distribution data 125 may indicate in the simplest case a modification in the transmitted level of the noise floor data. As said above also the first LPC coefficient may be used as energy distribution data 125. Therefore, if the audio signal 105 was encoded using LPC, further embodiments use the first LPC coefficient, which is already transmitted by the coded audio stream 345, as the energy distribution data 125. In this case there is no need to transmit in addition the energy distribution data 125.

Alternatively a modification of the noise floor may also be carried out after the calculation within the calculator 433 so that the noise floor modifying unit 431 may be arranged after the processor 433. In further embodiments the energy distribution data 125 may be directly input in the calculator 433 modifying directly the calculation of the noise floor as calculation parameter. Hence, the noise floor modifying unit 431 and the calculator/processor 433 may be combined to a noise floor modifier tool 433, 431.

In another embodiment the BWE tool 430 comprising the noise floor calculation tool comprises a switch, wherein the switch is configured to switch between a high level for the noise floor (positive spectral tilt) and a low level for the noise floor (negative spectral tilt). The high level may, for example, correspond to the case wherein the transmitted level for the noise is doubled (or multiplied by a factor), whereas the low level corresponds to the case wherein the transmitted level is decreased by factor. The switch may be controlled by a bit in the bit stream of the coded audio signal 345 indicating a positive or negative spectral tilt of the audio signal. Alternatively the switch may also be activated by an analysis of the decoded audio signal 105*a* (components in the first frequency band) or of the frequency subband audio signal $\mathbf{105}_{32}$, for example with respect to the spectral tilt (whether the spectral tilt is positive or negative).

Alternatively, the switch may also be controlled by the first LPC coefficient, since this coefficient indicates the spectral tile (see above).

Although some of the FIGS. 1, 3 through 5 are illustrated as block diagrams of apparatuses, these figures simultaneously are an illustration of a method, where the block functionalities correspond to the method steps.

As said above, an SBR time unit (SBR frame) or a time portion can be divided into various data blocks, so-called envelopes. This partition may be uniform over the SBR frame and allows adjusting flexibly the synthesis of the audio signal within the SBR frame.

Figure 6:
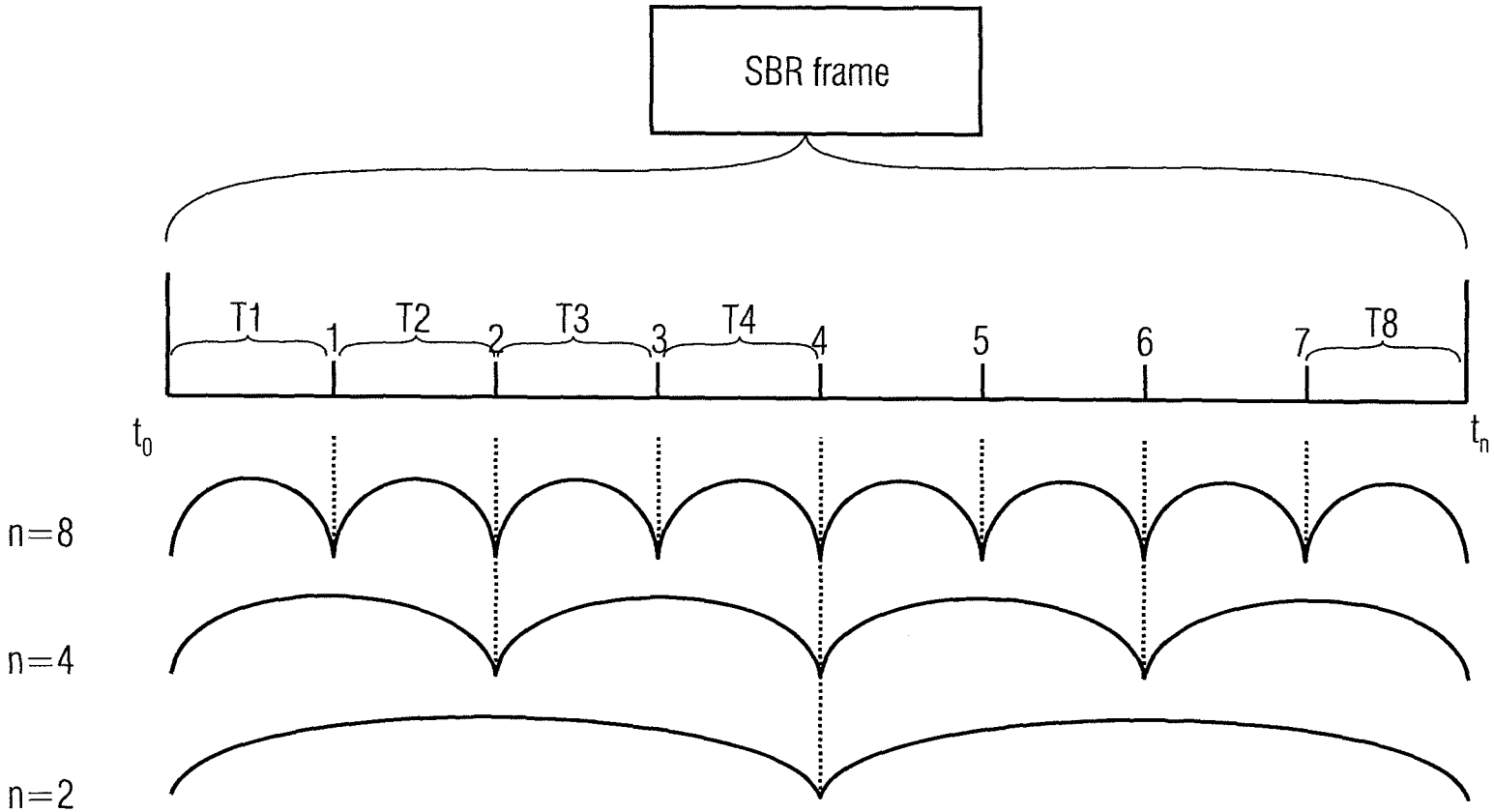
FIG. 6 illustrates the partition of an SBR frame in a predetermined number of time portions.

FIG. 6 illustrates such partition for the SBR frame in a number n of envelopes. The SBR frame covers a time period or time portion T between the initial time $t_0$ and a final time $t_n$. The time portion T is, for example, divided into eight time portions, a first time portion T1, a second time portion T2, . . . , an eighth time portion T8. In this example, the maximum number of envelopes coincides with the number of time portions and is given by n=8. The 8 time portions T1,. . . , T8 are separated by 7 borders, that means a border 1 separates the first and second time portion T1, T2, a border 2 is located between the second portion T2 and a third portion T3, and so on until a border 7 separates the seventh portion T7 and the eighth portion T8.

In further embodiments, the SBR frame is divided into four noise envelopes (n=4) or is divided into two noise envelopes (n=2). In the embodiment as shown in FIG. 6, all envelopes comprise the same temporal length, which may be different in other embodiments so that the noise envelopes cover differing time lengths. In detail, the case with two noise envelopes (n=2) comprise a first envelope extending from the time $t_0$ over the first four time portions (T1, T2, T3 and T4) and the second noise envelope covering the fifth to the eighth time portion (T5, T6, T7 and T8). Due to the Standard ISO/IEC 14496-3, the maximal number of envelopes is restricted to two. But embodiments may use any number of envelopes (e.g. two, four or eight envelopes).

In further embodiments the envelope data calculator 210 is configured to change the number of envelopes depending on a change of the measured noise floor data 115. For example, if the measured noise floor data 115 indicates a varying noise floor (e.g. above a threshold) the number of envelopes may be increased whereas in case the noise floor data 115 indicates a constant noise floor the number of envelopes may be decreased.

In other embodiments, the signal energy characterizer 120 can be based on linguistic information in order to detect sibilants in speech. When, for example, a speech signal has associated meta information such a the international phonetic spelling, then an analysis of this meta information will provide a sibilant detection of a speech portion as well. In this context, the meta data portion of the audio signal is analyzed.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

The invention claimed is:

1. An encoder for encoding an audio signal, the audio signal comprising components in a first frequency band and components in a second frequency band, the encoder comprising:

a core coder for encoding the components in the first frequency band to acquire an encoded audio signal;

an envelope data calculator for calculating bandwidth extension (BWE) data based on the components in the second frequency band, the envelope data calculator comprising an apparatus for generating bandwidth extension output data for the audio signal, the bandwidth extension output data being adapted to control a synthesis of the components in the second frequency band, the apparatus comprising:

a spectral envelope data calculator for calculating spectral envelope data of the second frequency band;

a noise floor measurer for measuring noise floor data of the second frequency band for a time portion of the audio signal;

a signal energy characterizer for deriving energy distribution data, in addition to the spectral envelope data, the energy distribution data characterizing an energy distribution in a spectrum of the time portion of the audio signal; and a processor for combining the noise floor data, the energy distribution data and the spectral envelope data to obtain the bandwidth extension output data, wherein the bandwidth extension output data comprise the noise floor data the energy distribution data and the spectral envelope data; and a bitstream payload formatter adapted for outputting a coded audio stream by combining the bandwidth extension output data with the encoded audio signal, wherein the processor is part of the bitstream payload formatter.

2. The encoder of claim 1, wherein the signal energy characterizer is configured to use, as energy distribution data, a sibilance parameter or a spectral tilt parameter, the sibilance parameter or spectral tilt parameter identifying an increasing or decreasing level of the audio signal with frequency.

3. The encoder of claim 2, wherein the signal energy characterizer is configured to use a first linear predictive coding coefficient as the sibilance parameter.

4. The encoder of claim 1, wherein the processor is configured to add the noise floor data and the spectral energy distribution data to a bitstream as the BWE output data.

5. The encoder of claim 1, wherein the processor is configured to change the noise floor data in accordance to the energy distribution data to acquire modified noise floor data, and wherein the processor is configured to add the modified noise floor data to a bitstream as the BWE output data.

6. The encoder of claim 5, wherein the change of the noise floor data is such that the modified noise floor is increased for an audio signal comprising more sibilance compared to an audio signal comprising less sibilance.

7. The encoder of claim 1, wherein the time portion covers an SBR frame, the SBR frame comprising a plurality of noise envelopes, and wherein the noise envelope data calculator is configured to calculate different BWE data for different noise envelopes of the plurality of noise envelopes.

8. The encoder of claim 1, wherein the envelope data calculator is configured to change a number of envelopes depending on a change of the measured noise floor data.

9. A method of encoding an audio signal, the audio signal comprising components in a first frequency band and components in a second frequency band, the method comprising:

encoding the components in the first frequency band to acquire an encoded audio signal;

calculating bandwidth extension data by an envelope data calculator based on the components in the second frequency band, calculating comprising generating bandwidth extension output data for the audio signal, the bandwidth extension output data being adapted to control a synthesis of the components in the second frequency band, generating bandwidth extension output data comprising:

calculating spectral envelope data of the second frequency band;

measuring noise floor data of the second frequency band for a time portion of the audio signal;

deriving energy distribution data, in addition to the spectral envelope data, the energy distribution data characterizing an energy distribution in a spectrum of the time portion of the audio signal; and combining the spectral envelope data, the noise floor data and the energy distribution data to obtain the bandwidth extension output data; wherein the bandwidth extension output data comprise the noise floor data, the energy distribution data, and the spectral envelope data, and bitstream payload formatting and outputting a coded audio stream by combining the bandwidth extension output data with the encoded audio signal, wherein combining is part of bitstream payload formatting.

10. A bandwidth extension tool for generating components in a second frequency band of an audio signal based on bandwidth extension output data and based on a raw signal spectral representation for the components in the second frequency band, wherein the bandwidth extension output data comprise energy distribution data, the bandwidth extension tool comprising:

a noise floor modifier tool, which is configured to modify a transmitted noise floor in accordance to the energy distribution data, the energy distribution data characterizing an energy distribution in a spectrum of a time portion of the audio signal, to obtain a modified transmitted noise floor;

a noise floor calculation tool for calculating modified noise spectral lines and raw signal lines based on spectral envelope data, the modified transmitted noise floor and the raw signal spectral representation; and a combiner for combining the raw spectral lines with the modified noise spectral lines to generate the components in the second frequency band with the modified noise floor, wherein the noise floor modifier tool or the combiner comprises a hardware implementation.

11. The bandwidth extension tool of claim 10, wherein the audio signal comprises components in a first frequency band and the bandwidth extension output data further comprise transmitted noise floor data indicating a noise level for the noise floor, and wherein the noise floor modifier tool is adapted to increase the noise level in case the energy distribution data indicates an audio signal comprising more energy in the components of the second frequency band than in first frequency band, or to decrease the noise level in case the energy distribution data indicates an audio signal comprising more energy in the components of the first frequency band than in the second frequency band.

12. A decoder for decoding a coded audio stream to acquire an audio signal comprising:

a bitstream deformatter separating an encoded signal and the BWE output data;

a bandwidth extension tool for generating components in a second frequency band of an audio signal based on bandwidth extension output data and based on a raw signal spectral representation for the components in the second frequency band, wherein the bandwidth extension output data comprise energy distribution data, the energy distribution data characterizing an energy distribution in a spectrum of a time portion of the audio signal, the bandwidth extension tool comprising: a noise floor modifier tool, which is configured to modify a transmitted noise floor in accordance to the energy distribution data to obtain a modified transmitted noise floor; a noise floor calculation tool for calculating modified noise spectral lines and raw spectral lines based on spectral envelope data, the modified transmitted noise floor and the raw signal spectral representation; and a combiner for combining the raw signal lines with the modified noise spectral lines to generate the components in the second frequency band with the modified noise floor;

a core decoder for decoding components in a first frequency band from the encoded audio signal; and a synthesis unit for synthesizing the audio signal by combining the components of the first and second frequency band, wherein the bitstream deformatter, the bandwidth extension tool, the core decoder or the synthesis unit comprises a hardware implementation.

13. A method for decoding a coded audio stream to acquire an audio signal, the audio signal comprising components in a first frequency band and bandwidth extension output data, wherein the bandwidth extension output data comprise energy distribution data and noise floor data, the energy distribution data characterizing an energy distribution in a spectrum of a time portion of the audio signal, the method comprising:

separating from the coded audio stream an encoded audio signal and the BWE output data;

decoding components in a first frequency band from the encoded audio signal;

generating a raw signal spectral representation for components in a second frequency band from the components in the first frequency band;

modifying a noise floor in accordance to the energy distribution data and in accordance to the transmitted noise floor data to obtain a modified transmitted noise floor;

calculating modified noise spectral lines and raw spectral lines based on spectral envelope data, the modified transmitted noise floor and the raw spectral representation;

combining the raw spectral lines with the modified noise spectral lines to generate the components in the second frequency band with the modified noise floor; and synthesizing the audio signal by combining the components of the first and second frequency band.

14. Non-transitory storage medium having stored thereon a computer program for performing, when running on a computer, a method of encoding an audio signal, the audio signal comprising components in a first frequency band and components in a second frequency band, the method comprising: encoding the components in the first frequency band to acquire an encoded audio signal; calculating bandwidth extension data by an envelope data calculator based on the components in the second frequency band, calculating comprising generating bandwidth extension output data for the audio signal, the bandwidth extension output data being adapted to control a synthesis of the components in the second frequency band, generating bandwidth extension output data comprising: calculating spectral envelope data of the second frequency band; measuring noise floor data of the second frequency band for a time portion of the audio signal; deriving energy distribution data, in addition to the spectral envelope data, the energy distribution data characterizing an energy distribution in a spectrum of the time portion of the audio signal; and combining the spectral envelope data, the noise floor data and the energy distribution data to obtain the bandwidth extension output data; and wherein the bandwidth extension output data comprise the spectral envelope data, the noise floor data and the energy distribution data; and bitstream payload formatting and outputting a coded audio stream by combining the bandwidth extension data with the encoded audio signal, wherein combining is part of bitstream payload formatting.

15. Non-transitory storage medium having stored thereon a computer program for performing, when running on a computer, a method for decoding a coded audio stream to acquire an audio signal, the audio signal comprising components in a first frequency band and bandwidth extension output data, wherein the bandwidth extension output data comprise energy distribution data and noise floor data, the energy distribution data characterizing an energy distribution in a spectrum of a time portion of the audio signal, the method comprising: separating from the coded audio stream an encoded audio signal and the BWE output data; decoding components in a first frequency band from the encoded audio signal; generating a raw signal spectral representation for components in a second frequency band from the components in the first frequency band; modifying a noise floor in accordance to the energy distribution data and in accordance to the transmitted noise floor data; combining the raw signal spectral representation with the modified noise floor to generate the components in the second frequency band with the calculated noise floor; and synthesizing the audio signal by combining the components of the first and second frequency band.

16. Non-transitory storage medium having stored thereon an encoded audio stream, comprising:

an encoded audio signal for components in a first frequency band of an audio signal;

noise floor data adapted to control a synthesis of a noise floor for components in a second frequency band of the audio signal;

energy distribution data adapted to control a modification of the noise floor; and spectral envelope data describing a spectral envelope of the components in the second frequency band.

17. A method for generating components in a second frequency band of an audio signal based on bandwidth extension output data and based on a raw signal spectral representation for the components in the second frequency band, wherein the bandwidth extension output data comprise energy distribution data, the method comprising:

modifying a transmitted noise floor in accordance to the energy distribution data, the energy distribution data characterizing an energy distribution in a spectrum of a time portion of the audio signal, to obtain a modified transmitted noise floor;

calculating modified noise spectral lines and raw spectral lines based on spectral envelope data, the modified transmitted noise floor and the raw signal spectral representation; and combining the raw spectral lines with the modified noise spectral lines to generate the components in the second frequency band with the modified noise floor.

18. Non-transitory storage medium having stored thereon a computer program for performing, when running on a computer, a method for generating components in a second frequency band of an audio signal based on bandwidth extension output data and based on a raw signal spectral representation for the components in the second frequency band, wherein the bandwidth extension output data comprise energy distribution data, the method comprising:

modifying a transmitted noise floor in accordance to the energy distribution data, the energy distribution data characterizing an energy distribution in a spectrum of a time portion of the audio signal, to obtain a modified transmitted noise floor;

calculating modified noise spectral lines and raw spectral lines based on spectral envelope data, the modified transmitted noise floor and the raw signal spectral representation; and combining the raw spectral lines with the modified noise spectral lines to generate the components in the second frequency band with the modified noise floor.

19. An encoder for encoding an audio signal, the audio signal comprising components in a first frequency band and components in a second frequency band, the encoder comprising:

a core coder for encoding the components in the first frequency band to acquire an encoded audio signal;

an bandwidth extension output data calculator for calculating bandwidth extension output data based on the components in the second frequency band, the bandwidth extension output data calculator comprising:

a noise floor measurer for measuring noise floor data of the second frequency band for a time portion of the audio signal;

a signal energy characterizer for deriving energy distribution data, the energy distribution data characterizing an energy distribution in a spectrum of the time portion of the audio signal; and a processor for combining the noise floor data and the energy distribution data to acquire the bandwidth extension output data, wherein the processor is configured to change the noise floor data in accordance to the energy distribution data to obtain modified noise floor data, wherein the processor is configured to change the noise floor data such that the modified noise floor is increased for an audio signal comprising more sibilance compared to an audio signal comprising less sibilance; and a bitstream payload formatter adapted for outputting a coded audio stream by combining the bandwidth extension output data comprising the modified noise floor data with the encoded audio signal.

20. An method of encoding an audio signal, the audio signal comprising components in a first frequency band and components in a second frequency band, the method comprising:

encoding the components in the first frequency band to acquire an encoded audio signal;

calculating bandwidth extension output data based on the components in the second frequency band, the bandwidth extension output data being adapted to control a synthesis of the components in the second frequency band, the calculating bandwidth extension output data comprising:

measuring noise floor data of the second frequency band for a time portion of the audio signal;

deriving energy distribution data, the energy distribution data characterizing an energy distribution in a spectrum of the time portion of the audio signal; and combining the noise floor data and the energy distribution data to acquire the bandwidth extension output data comprising changing the noise floor data in accordance to the energy distribution data to obtain modified noise floor data, wherein the modified noise floor is increased for an audio signal comprising more sibilance compared to an audio signal comprising less sibilance; and outputting a coded audio stream by combining the bandwidth extension output data comprising the modified noise floor data with the encoded audio signal.

21. Non-transitory storage medium having stored thereon a computer program for performing, when running on a computer, a method of encoding an audio signal, the audio signal comprising components in a first frequency band and components in a second frequency band, the method comprising:

encoding the components in the first frequency band to acquire an encoded audio signal;

calculating bandwidth extension output data based on the components in the second frequency band, the bandwidth extension output data being adapted to control a synthesis of the components in the second frequency band, the calculating bandwidth extension output data comprising:

measuring noise floor data of the second frequency band for a time portion of the audio signal;

deriving energy distribution data, the energy distribution data characterizing an energy distribution in a spectrum of the time portion of the audio signal; and combining the noise floor data and the energy distribution data to acquire the bandwidth extension output data comprising changing the noise floor data in accordance to the energy distribution data to obtain modified noise floor data, wherein the modified noise floor is increased for an audio signal comprising more sibilance compared to an audio signal comprising less sibilance; and outputting a coded audio stream by combining the bandwidth extension output data comprising the modified noise floor data with the encoded audio signal.

* * * * *